US010544998B2

(12) United States Patent
Hedberg et al.

(10) Patent No.: US 10,544,998 B2
(45) Date of Patent: Jan. 28, 2020

(54) ATTACHMENT MEANS, GASKET ARRANGEMENT AND ASSEMBLY

(71) Applicant: ALFA LAVAL CORPORATE AB, Lund (SE)

(72) Inventors: Magnus Hedberg, Malmo (SE); Johan Nilsson, Ronneby (SE)

(73) Assignee: ALFA LAVAL CORPORATE AB, Lund (SE)

( * ) Notice: Subject to any disclaimer, the term of this patent is extended or adjusted under 35 U.S.C. 154(b) by 968 days.

(21) Appl. No.: 14/436,909

(22) PCT Filed: Dec. 17, 2013

(86) PCT No.: PCT/EP2013/076856
§ 371 (c)(1),
(2) Date: Apr. 22, 2015

(87) PCT Pub. No.: WO2014/117902
PCT Pub. Date: Aug. 7, 2014

(65) Prior Publication Data

US 2015/0330720 A1 Nov. 19, 2015

(30) Foreign Application Priority Data

Jan. 30, 2013 (EP) ..... 13153167

(51) Int. Cl.
*F28F 3/08* (2006.01)
*F28F 3/10* (2006.01)

(52) U.S. Cl.
CPC . *F28F 3/08* (2013.01); *F28F 3/10* (2013.01)

(58) Field of Classification Search
CPC .. F28F 3/10; F28F 3/08; F28F 2275/14; F16J 15/061; F16B 5/0012; F16B 5/0016;
(Continued)

(56) References Cited

U.S. PATENT DOCUMENTS 2,938,252 A * 5/1960 Scheemaeker ..... B42F 1/02 24/547
3,536,287 A * 10/1970 Kramer ..... A47G 25/0614 248/215

(Continued)

FOREIGN PATENT DOCUMENTS

CN 102393155 A 3/2012
DE 10035776 C1 12/2001

(Continued)

OTHER PUBLICATIONS

Office Action dated Oct. 4, 2016, by the Federal Service for Intellectual Property in corresponding Russian Patent Application No. 2015136561/06 with an English translation of the Office Action. (11 pgs).

(Continued)

*Primary Examiner* — Jianying C Atkisson
*Assistant Examiner* — For K Ling
(74) *Attorney, Agent, or Firm* — Buchanan Ingersoll & Rooney PC

(57) ABSTRACT

An attachment member is arranged to engage an edge portion of a heat exchanger plate for fastening a gasket to a first side of the heat exchanger plate. It comprises a first connection member, a second connection member and a bridge. A first part of the first connection member is arranged to engage the gasket while a second part of the first connection member engages the bridge. A first part of the second connection member is arranged to engage the gasket while and a second part of the second connection member engages with the bridge. The attachment member further comprises a plurality of fingers arranged between the first and second connection members. A respective connection part of each finger engages the bridge and the fingers are arranged to extend from the bridge towards the gasket.

16 Claims, 4 Drawing Sheets

(58) Field of Classification Search
CPC .... F16B 5/0607; F16B 5/0635; F16B 5/0657; F16B 5/0664; F16B 5/12; F16B 5/121–126; F16B 2/20; F16B 2/22; F16B 45/00; F16B 2/241; B42F 1/02; A47G 25/0614; A47G 25/0642; A47G 25/0628; A47G 25/0635
USPC ..... 277/637, 638, 640, 616, 648; 248/229.1, 248/229.26, 690, 490
See application file for complete search history.

(56) References Cited

U.S. PATENT DOCUMENTS 3,730,466 A * 5/1973 Swanquist ..... H02G 3/125 220/3.9
4,135,668 A * 1/1979 Winkler ..... B05B 15/622 239/276
4,480,356 A * 11/1984 Martin ..... B42F 1/02 24/545
4,635,715 A * 1/1987 Andersson ..... F28F 3/10 165/166
4,779,369 A * 10/1988 Hill ..... F16B 5/0664 248/223.41
4,905,758 A * 3/1990 Mathur ..... F28F 3/10 165/166
5,178,212 A * 1/1993 Nakamura ..... F28F 3/10 165/166
5,214,825 A * 6/1993 Hirzel ..... B42F 1/02 24/547
5,727,620 A * 3/1998 Schaufele ..... F28F 3/10 165/166
5,887,650 A * 3/1999 Yang ..... F28F 3/10 165/166
5,927,395 A * 7/1999 Damiani ..... F28F 3/10 165/166
5,988,268 A * 11/1999 Usami ..... F28F 3/10 165/166
6,186,224 B1 * 2/2001 Seidel ..... F28F 3/10 165/166
6,389,658 B1 * 5/2002 Pfaller ..... F16B 2/245 220/3.9
6,513,584 B2 * 2/2003 Lehmann ..... F28F 3/10 165/166
6,638,118 B2 * 10/2003 McCoy ..... H01R 4/4809 439/439
6,973,960 B1 12/2005 Seidel
7,627,973 B2 * 12/2009 Lin ..... G06F 1/1601 24/297
2011/0146194 A1 * 6/2011 Tedesco ..... E04B 9/30 52/665
2011/0259561 A1 10/2011 Krantz
2015/0247682 A1 9/2015 Nilsson et al.
2015/0253087 A1 9/2015 Hedberg et al.
2015/0276319 A1 10/2015 Hedberg et al.

FOREIGN PATENT DOCUMENTS

JP S60-501568 A 9/1985
JP H08-271178 A 10/1996
JP 2000-097583 A 4/2000
JP 2002-519614 A 7/2002
JP 2012-512382 A 5/2012
KR 10-2011-0086169 7/2011
RU 2225580 C2 3/2004
WO WO 85/00052 A1 1/1985
WO WO 99/67589 A2 12/1999
WO WO 00/77468 A1 12/2000
WO WO 2004/072570 A1 8/2004
WO WO 2010/071551 A2 6/2010
WO WO 2010/092556 A1 8/2010

OTHER PUBLICATIONS

International Search Report (PCT/ISA/210) dated Mar. 11, 2014, by the European Patent Office as the International Searching Authority for International Application No. PCT/EP2013/076856.
Written Opinion (PCT/ISA/237) dated Mar. 11, 2014, by the European Patent Office as the International Searching Authority for International Application No. PCT/EP2013/076856.
An English Translation of the Office Action (Notice of Reasons for Rejection) dated Aug. 8, 2016, by the Japanese Patent Office in corresponding Japanese Patent Application No. 2015-554076. ( 3 pages).
Office Action (Notification of Reason for Refusal) dated Aug. 29, 2016, by the Korean Intellectual Property Office in corresponding Korean Patent Application No. 10-2015-7022994, and an English Translation of the Office Action. (6 pages).

* cited by examiner

ATTACHMENT MEANS, GASKET ARRANGEMENT AND ASSEMBLY

TECHNICAL FIELD

The invention relates to an attachment means arranged to engage with an edge portion of a heat exchanger plate for fastening a gasket to a first side of the heat exchanger plate according to the preamble of claim 1. The invention also relates to a gasket arrangement comprising such a gasket and such an attachment means. Further, the invention relates to an assembly comprising such a heat exchanger plate, such a gasket and such an attachment means.

BACKGROUND ART

Plate heat exchangers, PHEs, typically consist of two end plates in between which a number of heat transfer plates are arranged in an aligned manner, i.e. in a stack. In one type of well-known PHEs, the so called gasketed PHEs, gaskets are arranged between the heat transfer plates, typically in gasket grooves which extend along edges of the heat transfer plates. The end plates, and therefore the heat transfer plates, are pressed towards each other whereby the gaskets seal between the heat transfer plates. The gaskets define parallel flow channels between the heat transfer plates through which channels two fluids of initially different temperatures alternately can flow for transferring heat from one fluid to the other. In order for the channels not to leak it is naturally essential that the gaskets are properly positioned between the plates.

When the plate heat exchanger is closed, the gaskets are squeezed between the plates and thereby securely held in place. However, when the gaskets are not squeezed between the plates, such as when the plate heat exchanger is assembled or open for maintenance, some kind of means for fixing the gaskets correctly to the plates are desirable. It is known to use some kind of adhesive means, such as glue or tape, for fixing the gaskets to the plates. However, attaching the gaskets by adhesive is relatively time-consuming and therefore expensive. Further, fixing by adhesive may negatively affect the gaskets and their sealing capacity. Also mechanical gasket fixing solutions are previously known, for example through applicant's own U.S. Pat. No. 4,635,715. This document discloses different embodiments of gaskets provided with projections for securing the gaskets to heat transfer plates. The gaskets described herein may be difficult to handle, more particularly relatively prone to tangling in that the projections may get stuck in each other or in other objects, and/or they may provide relatively unreliable fastening to the heat transfer plates in that the engagement between the projections and the heat transfer plates is relatively weak.

SUMMARY

An object of the present invention is to provide an attachment means for fastening a gasket to a heat exchanger plate that provides a more reliable gasket fastening and more easy handling as compared to prior art. The basic concept of the invention is to provide the attachment means with a plurality of "enclosed" fingers arranged to engage with both sides of the heat exchanger plate for mutually "pinching" it. Other objects of the present invention is to provide a gasket arrangement comprising such a gasket and attachment means, and an assembly comprising such a heat exchanger plate, gasket and attachment means.

The attachment means, gasket arrangement and assembly for achieving the objects above are defined in the appended claims and discussed below.

An attachment means according to the present invention is arranged to engage with an edge portion of a heat exchanger plate for fastening a gasket to a first side of the heat exchanger plate. It comprises a first connection member, a second connection member and a bridge. A first part of the first connection member is arranged to engage with the gasket and a second part of the first connection member engages with the bridge. Similarly, a first part of the second connection member is arranged to engage with the gasket and a second part of the second connection member engages with the bridge. The attachment means is characterized in that it further comprises a plurality of fingers arranged between the first and second connection members. A respective connection part of each finger engages which the bridge and the fingers are arranged to extend from the bridge towards the gasket. At least one of the fingers is arranged to engage with the first side of the heat exchanger plate and at least another one of the fingers is arranged to engage with a second opposite side of the heat exchanger plate.

The attachment means could be formed integrally with the gasket or as a separate, possibly exchangeable, part.

Herein, the term heat exchanger plate is meant to comprise different kinds of plates, such as end plates and heat transfer plates similar to the ones referred to above, and distance plates.

Since the fingers are enclosed by a frame formed by the first and second connection members together with the bridge, the risk of the fingers accidentally getting stuck somewhere is relatively small. The frame construction is also beneficial as regards the rigidity of the attachment means by comparison with a more "open" construction.

By the attachment means comprising at least one finger for engagement with the first heat exchanger plate side and at least another finger for engagement with the second heat exchanger plate side, the edge portion of the heat exchanger plate may be squeezed between the fingers whereby the attachment means may be firmly fixed to the heat exchanger plate.

One or more of the fingers arranged to engage with the first side of the heat exchanger plate could be arranged to engage with the gasket. Alternately, the attachment means could be such that the fingers each has a free end which may facilitate assembly of the attachment means onto the heat exchanger plate.

The free end of a first one of the fingers may be arranged to be positioned closer to the gasket than the free end of a second one of the fingers. Such a feature may facilitate the arrangement of the first and second fingers on the different sides of the heat exchanger plate as will be further explained later on in the text. Further, such a feature can be obtained in different ways, e.g. by making the first finger longer than the second finger, which enables a relatively mechanically straightforward construction of the attachment means. Said first one of the fingers may be arranged to engage with the first side of the heat exchanger plate while said second one of the fingers may be arranged to engage with the second side of the heat exchanger plate.

The attachment means may be such that the free end of the first finger is chamfered at a surface arranged to face the heat exchanger plate, and the free end of the second finger is chamfered at a surface arranged to face away from the heat exchanger plate. Thereby, a relatively sleek design of the attachment means is enabled, also after application of the attachment means onto the heat exchanger plate. Also, as regards the first finger, the chamfering may facilitate arrangement of the first finger on the correct side, i.e. the first side, of the heat exchanger plate.

The attachment means may be so constructed that every other one of the fingers is arranged to engage with the first side, while the rest of the fingers is arranged to engage with the second side, of the heat exchanger plate. Such an alternating engagement enables a strength optimized fastening of the attachment means to the heat exchanger plate.

The attachment means may comprise three fingers, wherein a middle finger is arranged to engage with the first side of the heat exchanger plate. Since the first and second connection members are arranged to engage with the gasket to be fastened to the first side of the heat exchanger plate, the first and second connection members are arranged to be positioned on the first side of the heat exchanger plate. Thus, this embodiment enables that the first and second connection members and the middle finger engage the first side of the heat exchanger plate while one finger arranged between the middle finger and the first connection means, and another finger arranged between the middle finger and the second connection means, engage the second side of the heat exchanger plate. Thereby, a strong engagement between the attachment means and the heat exchanger plate can be achieved.

The bridge of the attachment means may have a center portion that is wider than the rest of the bridge. Thereby, application of the attachment means onto the heat exchanger plate may be facilitated. Further, this feature may increase the rigidity of the bridge.

According to one embodiment of the inventive attachment means, the bridge is thicker than the fingers. Such an embodiment may mean that the bridge is more rigid than the fingers which, in turn, may facilitate application of the attachment means onto the heat exchanger plate.

The first and second connection elements may be tapered, so as to be less thick, at their respective first part. Thereby, the first and second connection elements may engage with a portion of the gasket that is thinner than the first and second connection elements at their respective second part without affecting the sealing capacity of the gasket. Further, thicker (at least partially) first and second connection elements are beneficial as regards the rigidity of the attachment means.

The fingers (one or more) arranged to engage with the first side of the heat exchanger plate may be tapered, so as to be less thick, at their respective connection part. Further, the fingers (one or more) arranged to engage with the second side of the heat exchanger plate may be tapered, so as to be thicker at their respective connection part. With such a design, after application of the attachment means onto the heat exchanger plate, the fingers may follow the heat exchanger plate more closely and thus engage stronger therewith.

A gasket arrangement according to the present invention comprises a gasket and an attachment means as described above.

The gasket arrangement may comprise a plurality of attachment means arranged along the gasket, wherein an infinite straight imaginary line extending parallel to the first side of the heat exchange plate and perpendicularly to the gasket, when the gasket is fastened to the heat transfer plate, extends through one of the attachment means only. Thereby, contact between attachment means of neighboring stacked heat exchanger plates can be avoided.

An assembly according to the present invention comprises a heat exchanger plate, a gasket and an attachment means as described above.

The assembly may be such that the heat exchanger plate comprises, on the first side thereof, a gasket groove extending along an edge of the heat exchanger plate. The edge portion of the heat exchanger plate extends between the edge and the gasket groove and it is corrugated so as to comprise alternately arranged ridges and valleys. The gasket is arranged in the gasket groove. The attachment means is arranged around the edge of the heat exchanger plate whereby the first and second connection members and the fingers (one or more) arranged to engage with the first side of the heat exchanger plate are arranged in a respective one of the valleys of the edge portion and the fingers (one or more) arranged to engage with the second side of the heat exchanger plate are arranged underneath a respective one of the ridges of the edge portion.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
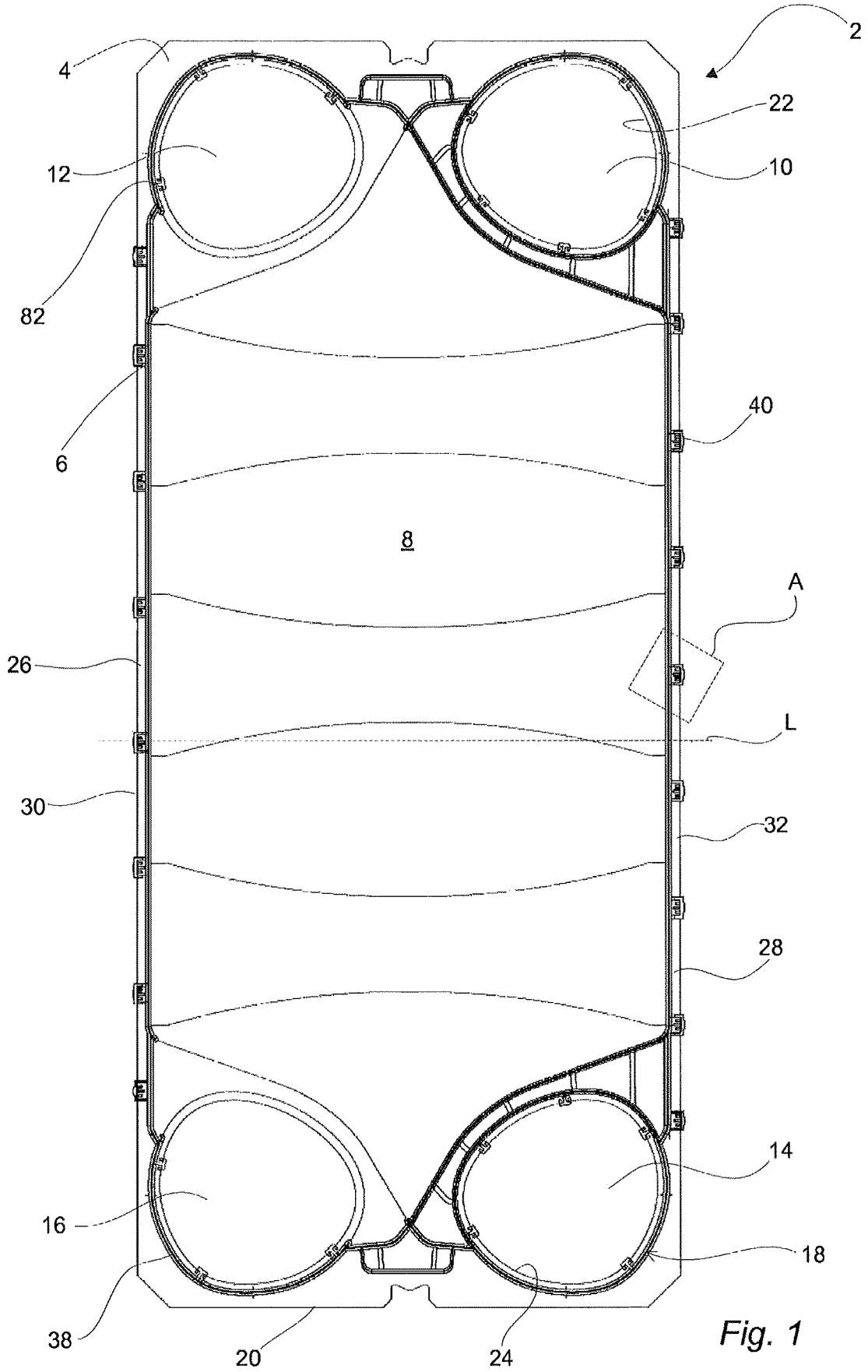
FIG. 1 is a plan view of an assembly comprising a heat exchanger plate and a gasket arrangement.
Figure 2:
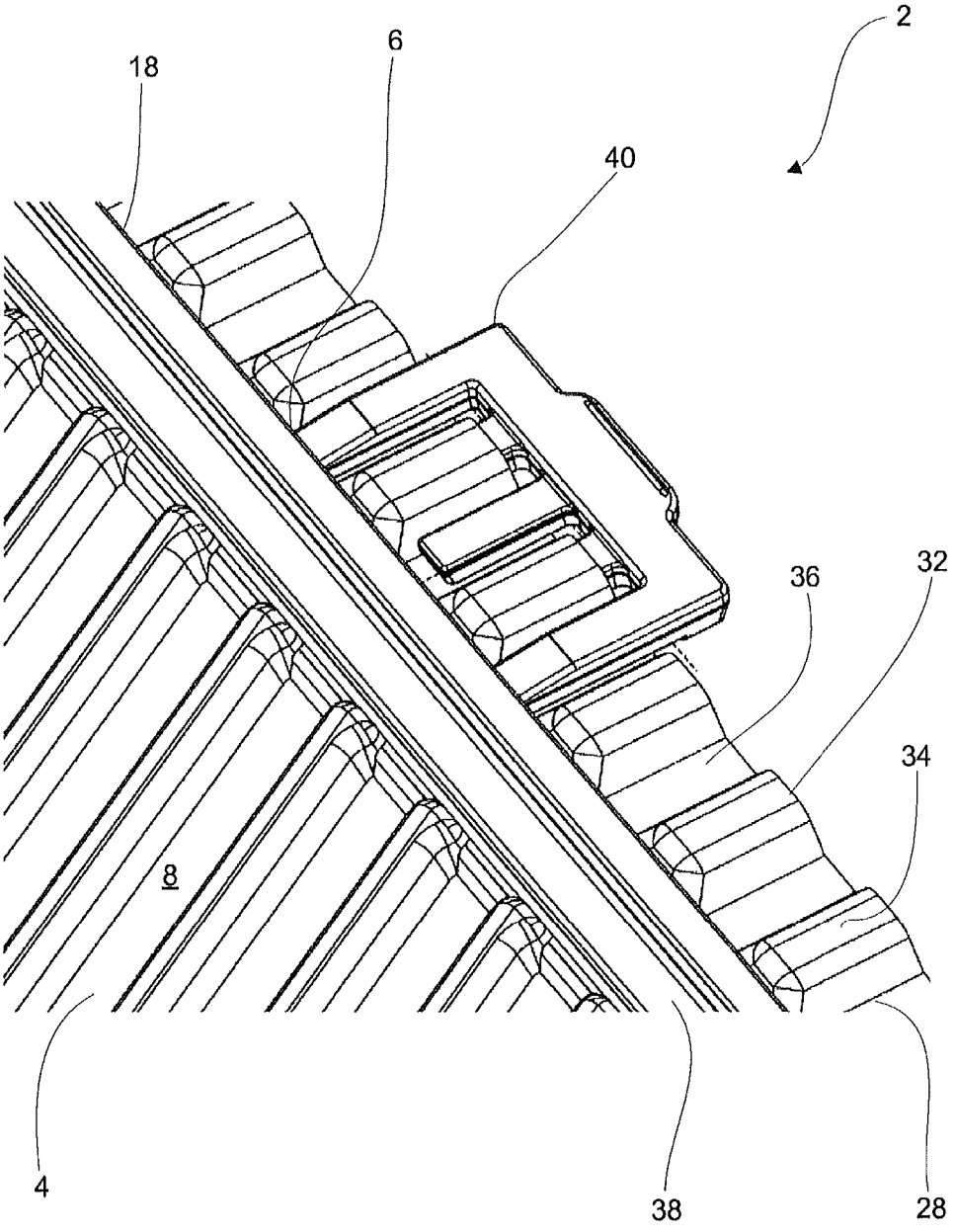
FIG. 2 is a partial enlargement of the assembly of FIG. 1.
Figure 3:
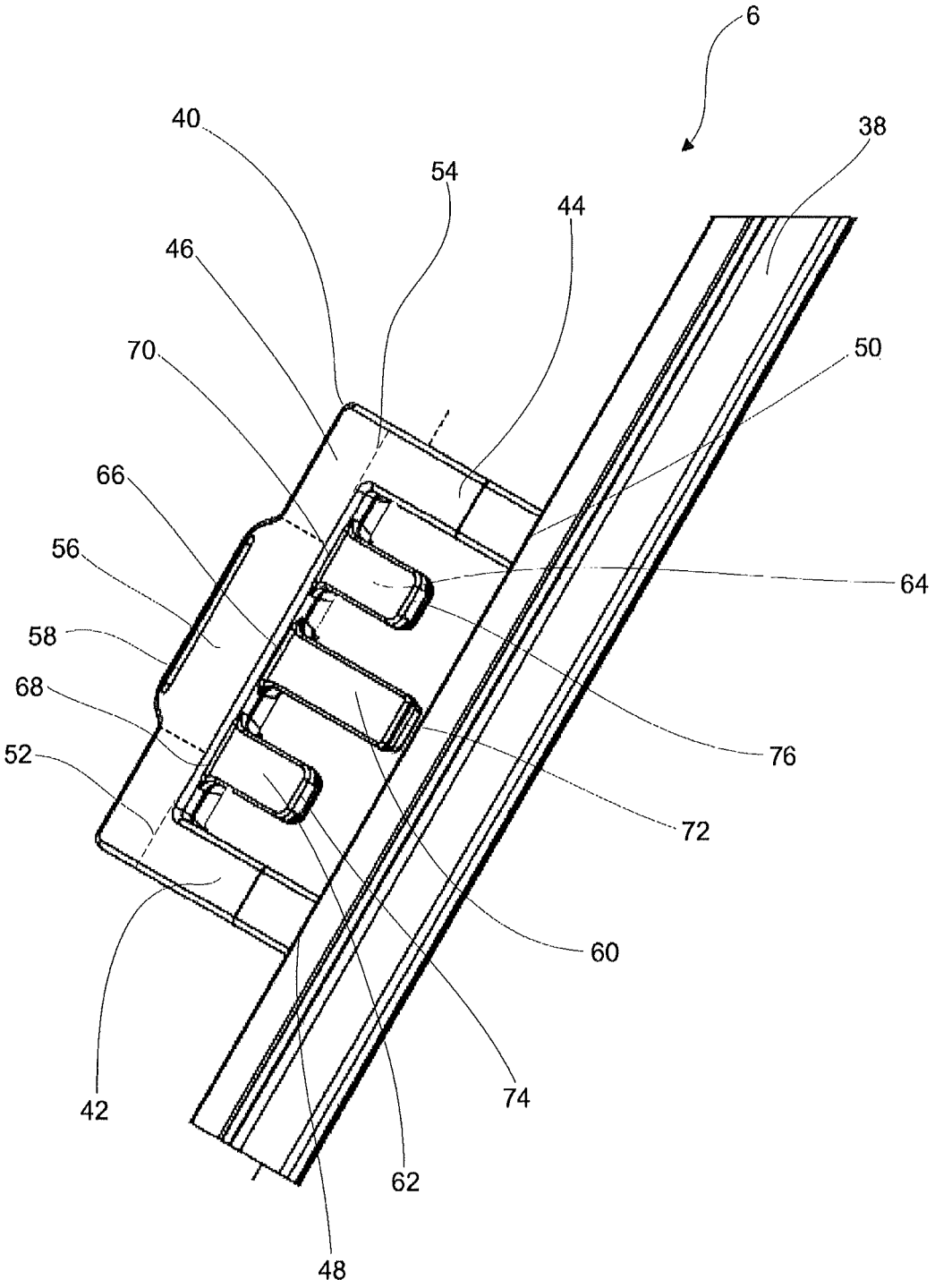
FIG. 3 is a partial perspective view of the gasket arrangement of the previous figures.

With reference to FIGS. 1 and 2, an assembly 2 comprising a heat exchanger plate, in the form of a heat transfer plate 4, and a gasket arrangement 6 is shown. FIG. 2 shows an enlargement of a part of the assembly enclosed by the dashed rectangle A in FIG. 1. The heat transfer plate 4, of which a first side 8 is visible in the figures, is an essentially rectangular sheet of stainless steel provided with a number of port holes 10, 12, 14 and 16, and pressed with specific patterns within different areas of the heat transfer plate (illustrated in FIG. 2 only). The heat transfer plate 4 comprises a gasket groove 18 extending along an outer plate periphery 20 to enclose the port holes 10, 12, 14 and 16, and completely along two inner plate peripheries 22 and 24 defining two of the port holes 10 and 14, respectively, to separately enclose these. Further, the gaskets groove 18 extends twice "diagonally" across the heat transfer plate so as to further enclose the port holes 10 and 14. The heat transfer plate 4 further comprises a first and a second longitudinal edge portion 26 and 28, respectively, extending between the gasket groove 18 and a first and a second longitudinal edge 30 and 32, respectively, of the heat transfer plate 4. The edge portions 26 and 28 are corrugated so as to comprise alternately arranged ridges 34 and valleys 36 (illustrated in FIG. 2 only). The heat transfer plate 4 will not be further described herein. For a more detailed description of it, reference is made to applicant's copending patent applications EP 12190493.2 and EP 12190496.5, which are hereby incorporated herein by reference.

The gasket arrangement 6 comprises a rubber gasket 38, a straight part of which is illustrated in FIGS. 3 and 4*a*-4*e*, and a number of rubber attachment means 40 integrally formed with the gasket, one of these attachment means being illustrated in more detail in FIGS. 3 and 4*a*-4*e*. The attachment means 40 comprises a first connection member 42, a second connection member 44 and a bridge 46. The first and second connection elements are essentially similar and they have a length equal to, or exceeding, a width of the first and second longitudinal edge portions 26 and 28. A first part, more particularly a first end 48, of the first connection member 42 is connected to the gasket 38. Similarly, a first part, more particularly a first end 50, of the second connection member 44 is connected to the gasket 38. The first and second connection members are separated from, and essentially parallel to, each other, and they project essentially perpendicularly from the gasket. Thus, the bridge has a longitudinal extension in an y-direction, a width extension in an x-direction and a thickness extension in a z-direction, the x- y- and z-directions being orthogonal in relation to each other, while the first and second connection members have a longitudinal extension in the x-direction, a width extension in the y-direction and a thickness extension in the z-direction. A second part, more particularly a second end 52, of the first connection member 42 is connected to the bridge 46. Similarly, a second part, more particularly a second end 54, of the second connection member 44 is connected to the bridge 46. The bridge 46 extends essentially parallel to the gasket 38 and it has a length equal to, or exceeding, 3×a width of the valleys 36+2×a width of the ridges 34. A center portion 56 of the bridge 46 is wider than the rest of the bridge and an upper surface 57 of it is provided with a friction increasing structure in the form of an elongate projection 58 extending essentially parallel to the gasket, i.e. along the y-direction, for facilitating application of the gasket arrangement, as will be further described below.

The attachment means 40 further comprises a first or middle finger 60, a second finger 62 and a third finger 64 arranged between the first and second connection members 42 and 44. A respective connection part, more particularly a first end 66, 68 and 70, of the fingers is connected to the bridge 46. The fingers are separated from, and essentially parallel to, each other, and they project essentially perpendicularly from the bridge towards the gasket 38. Thus, the fingers have a longitudinal extension in the x-direction, a width extension in the y-direction and a thickness extension in the z-direction. A respective second end 72, 74 and 76 of the fingers is free. The second and third fingers 62 and 64 are essentially similar. The first finger 60 is longer than the second and third fingers 62 and 64 which means that the free end 72 of the first finger is arranged closer to the gasket 38 than the free ends 74 and 76 of the second and third fingers. The advantage therewith will be explained below.

A gasketed plate heat exchanger constructed in accordance with the present invention comprises a compressed stack of heat transfer plates 4, each two heat transfer plates being separated by a gasket arrangement 6. In connection with assembly of the plate heat exchanger, each heat transfer plate 4 is provided with a gasket arrangement, wherein the gasket 38 is arranged in the gasket groove 18 on the first side 8 of the heat transfer plate and the attachment means 40 are arranged in engagement with the first and the second longitudinal edge portion 26 and 28, respectively, of the heat transfer plate 4. More particularly, each of the attachment means 40 is so fastened to the heat transfer plate 4 that the first and the second connection members 42 and 44, respectively, as well as the middle or first finger 60, are arranged on the first side 8 of the heat transfer plate 4, in a respective one of the valleys 36 of the edge portions 26 and 28. Further, the second and third fingers 62 and 64, respectively, are arranged on a second side (not shown), which is opposite to the first side 8, of the heat transfer plate 4, beneath a respective one of the ridges 34. Arranged like that, the first and second connection members and the first, second and third fingers together squeeze the heat transfer plate 4 to attach the gasket 38 in the groove 18 thereof. This is illustrated in FIG. 2.

In the stack of heat transfer plates 4, the first side of one heat transfer plate faces the second side of a neighboring heat transfer plate. Every second heat transfer plate 4 is rotated 180 degrees, in relation to a reference orientation (illustrated in FIG. 1), around a normal direction of the figure plane of FIG. 1. The attachment means along the first longitudinal edge 30 are displaced in relation to the attachment means along the second longitudinal edge 32 of the heat transfer plate 4. In other words, the attachment means arranged along the second longitudinal edge 32 are all displaced from an imaginary straight line (L) extending through any one of the attachment means arranged along the first longitudinal edge 30, which line is perpendicular to the first and second longitudinal edges 30 and 32 and parallel to the first side 8 of the heat transfer plate 4. This is to avoid contact between the attachment means of neighboring heat transfer plates in the stack, which contact could cause that the attachment means stick together.

Figure 4A:
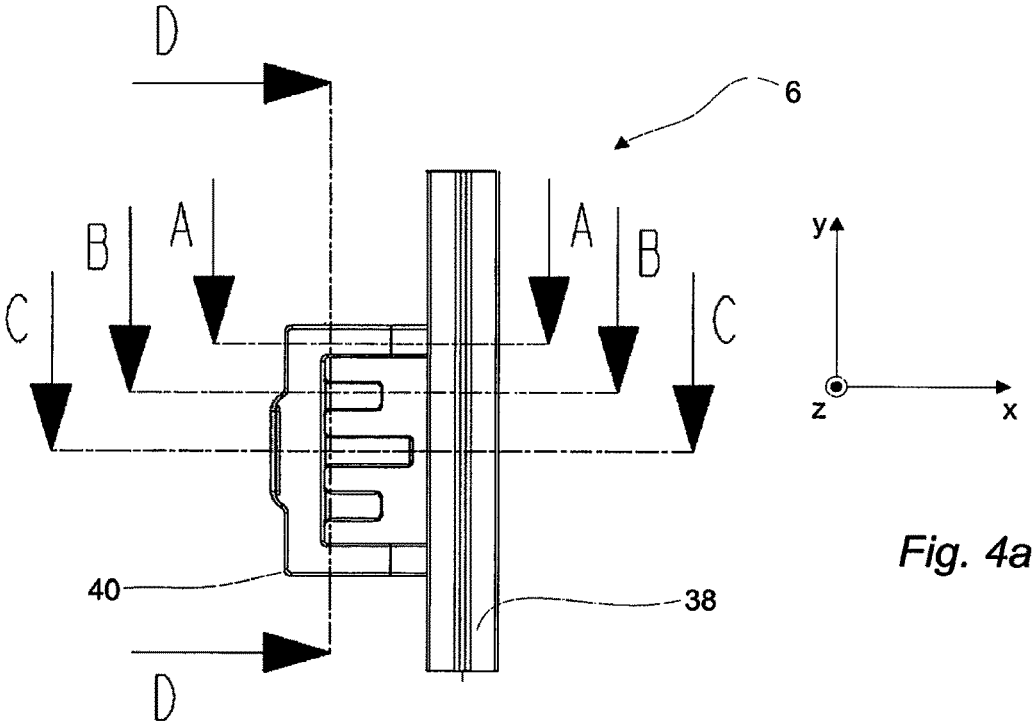
FIG. 4*a* is a partial plan view of the gasket arrangement of the previous figures.
Figure 4B:
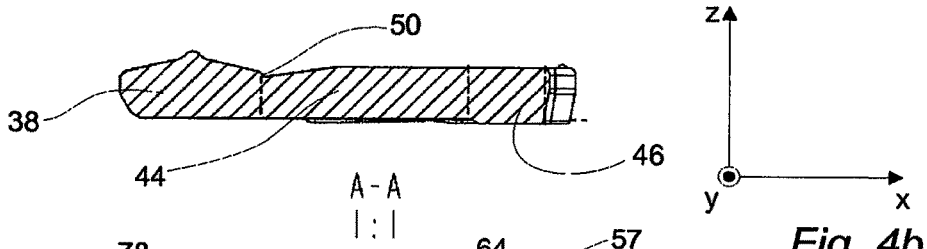
FIG. 4*b* is a cross section of the gasket arrangement, taken along line A-A in FIG. 4*a*.
Figure 4C:
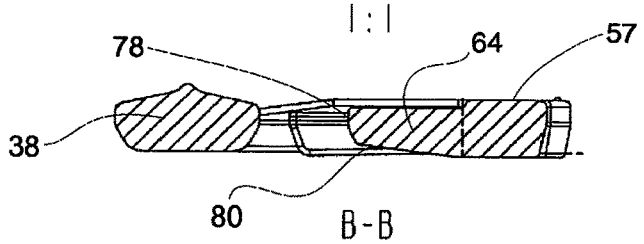
FIG. 4*c* is a cross section of the gasket arrangement, taken along line B-B in FIG. 4*a*.

As is most clearly illustrated in FIGS. 4*b*, the gasket 38 is, at its connection to the first and second connection members 42 and 44, thinner than the first and second connection elements are at their respective second ends 52 and 54, respectively. In order not to extend beyond the gasket, with the risk of affecting its sealing capacity when pressed against another heat transfer plate, the first and second connection members are tapered such as to be less thick at their respective first ends 48 and 50 where they join the gasket 38.

Figure 4D:
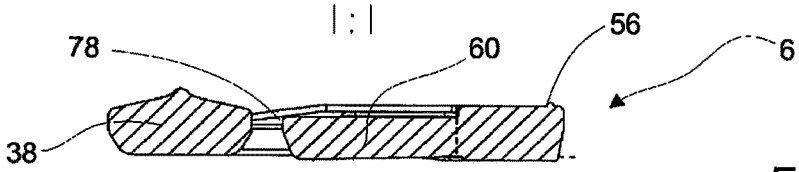
FIG. 4*d* is a cross section of the gasket arrangement, taken along line C-C in FIG. 4*a*.
Figure 4E:
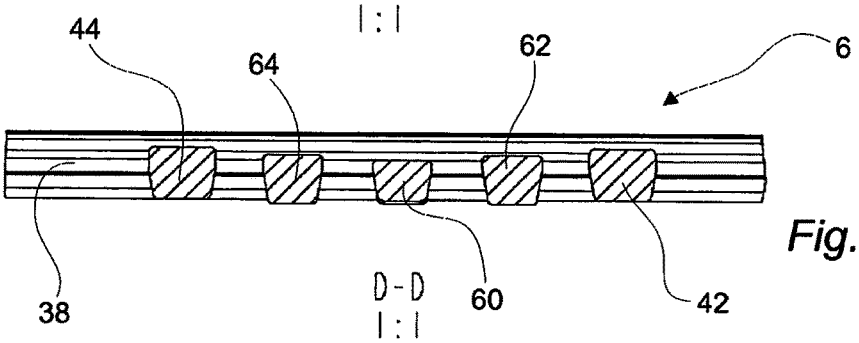
FIG. 4*e* is a cross section of the gasket arrangement, taken along line D-D in FIG. 4*a*.

Further, as is most clearly illustrated in FIG. 4*d*, the free end 72 of the first finger 60 is chamfered at a surface 78 arranged to face the heat transfer plate 4 when the gasket arrangement 6 is applied thereon. One purpose of this chamfering is to give the attachment means a less sprawling impression when fixed to the heat transfer plate 4 since the finger 60 may not engage, depending on its stiffness and exact shape, with the first side of the heat transfer plate across the entire surface 78. Another purpose is to facilitate the application of the attachment means onto the heat transfer plate. Similarly, as is most clearly illustrated in FIG. 4*c*, the free ends 76 and 78 of the second and third fingers 62 and 64, respectively, are chamfered at a respective surface 80 arranged to face away from the heat transfer plate 4 when the gasket arrangement 6 is applied thereon. Also here, a purpose of the chamfering is to give the attachment means a less sprawling impression when fixed to the heat transfer plate 4 since the fingers 62 and 64 may not engage, depending on their stiffness and exact shape, with the second side of the heat transfer plate along their entire respective extension. Another purpose of this chamfering is to make the second and third fingers less prone to engagement with an underlying external structure in connection with application of the attachment means onto the heat transfer plate.

Moreover, as is most clearly illustrated in FIG. 4*d*, the first finger 60 arranged to engage with the first side 8 of the heat transfer plate 4 is tapered so as to be less thick at its first end 66 where it connects to the bridge 46. The purpose thereof is to increase the contact between the heat transfer plate and the first finger. Further, as is most clearly illustrated in FIG. 4*c*, the second and third fingers 62 and 64 arranged to engage with the second side of the heat transfer plate 4 are tapered so as to be thicker at their respective first ends 68 and 70, respectively, where they connect to the bridge 46. The purpose thereof is given in the above paragraph, i.e. to give the attachment means a smoother appearance when fixed to the heat transfer plate.

Other features of the attachment means 40 is that the bridge 46 is thicker, and thus more rigid, than the first, second and third fingers.

When the gasket arrangement 6 is fastened to the heat transfer plate 4, all the attachment means 40 are brought into engagement with the plate edge portions. The rubber of which the gasket arrangement is made is flexible and that is taken advantage of when the gasket arrangement is mounted onto the heat transfer plate. Each of the attachment means 40 is grabbed by the bridge 46, which operation is facilitated and rendered more effective by the wider center portion 56, as well as the elongate projection 58, of the bridge which increase the grab surface and improves the grip by increased friction. The gasket 38, and partly the first connection element 42, the second connection element 44 and the first finger 60, are placed onto the heat transfer plate in line with their respective groove 18 and valleys 36 in such a way that the second and third fingers 62 and 64 are still arranged outside the heat transfer plate. The bridge is acted upon, by pressure and/or rotation, such that the first and second connection elements and the first finger bend and at least the free second ends 74 and 76 of the second and third fingers are moved past the edge of the heat transfer plate and to an underside of the same. Finally, the bridge is pushed in a direction perpendicular to a normal direction of the heat transfer plate to achieve engagement between the second and third fingers and the second side of the heat transfer plate. The bridge is so pushed until the gasket 38 gets properly positioned inside the gasket groove 18. The above described procedure resembles the method of applying a paper clip. Thus, the longer first finger functions as a support and aids in the positioning of the second and third fingers on the second side of the heat transfer plate.

The above described embodiment of the present invention should only be seen as an example. A person skilled in the art realizes that the embodiment discussed can be varied in a number of ways without deviating from the inventive conception.

As an example, the above described gasket arrangement comprises a plurality of attachment means distributed along an outside of the gasket so as to engage with the first and second longitudinal edges of the heat transfer plate. Naturally, one or more of the attachment means could instead be arranged to engage with a first and/or a second transverse edge of the heat transfer plate. Further, the gasket arrangement above comprises another type of fixing means 82, not constructed in accordance with the present invention, distributed along an inside of the gasket and arranged to engage with the heat transfer plate along the port hole edges. Naturally, one or more of the fixing means 82 could be replaced by an attachment means according to the present invention.

The present invention can be used in connection with alternative gasket designs, for example a gasket arranged to enclose the port holes once only, whereby the gasket could be essentially rectangular, or a ring gasket arranged to enclose one of the port holes only.

The attachment means need not comprise three fingers like above but could comprise any plurality of fingers. Further, the fingers need not be arranged to alternately engage with the first and second sides of the heat transfer plate. Thus, two adjacent fingers could be arranged to engage with the same side of the heat transfer plate. Furthermore, the middle finger of the attachment means could alternately be arranged to engage with the second side of the heat transfer plate.

The fingers of the above described attachment means each has a free second end. Naturally, the attachment means could alternatively be so constructed that one or more of the fingers arranged to engage with the first side of the heat transfer plate has a respective second end that is not free but instead arranged to engage with the gasket. Further, such a finger could be similar to the first and/or the second connection member.

The gasket and the attachment means must not be integrally formed but could be two separate but connectable parts. Further, the gasket and attachment means need not be made of rubber but can be made of any suitable material. Further, the gasket and attachment means need not be of the same material.

The first and second connection members of the above attachment means extend from the bridge to the gasket but they could instead extend beyond the bridge and/or the gasket. Similarly, the fingers could extend beyond the bridge and/or the gasket.

The assembly according to the above embodiment is such that the gasket groove and the valleys of the longitudinal edge portions essentially are in the same plane. Naturally, alternative embodiments are possible where the gasket groove and the valleys are in different planes.

The middle first finger of the above attachment means is longer than the second and third fingers in order to have the free second end of the first finger arranged closer to the gasket than the respective free second ends of the second and third fingers. As described above, this is to facilitate the application of the attachment means onto the heat transfer plate. However, there are alternative ways to achieve this ease-of-application feature than to vary the length of the fingers, such as by a suitable design of the bridge. As an example, the bridge could be provided with a bend or bulge towards the gasket such as to position the free second end of the first finger closer to the gasket.

According to an alternative embodiment of the invention, the free second end of the middle first finger of the attachment means could instead be arranged farther away from the gasket than the respective free second ends of the second and third fingers, also to facilitate the application of the attachment means onto the heat transfer plate. Such an embodiment could be realized by a shorter middle first finger or a suitable design of the bridge. In connection with application of such an attachment means onto the heat transfer plate, the longer second and third fingers would instead function as supports and aid in the positioning of the first finger on the first side of the heat transfer plate.

One or more of the fingers and connection members as well as the bridge of the attachment means could be formed in an alternative way than the above described. For example, the fingers and/or the connection members need not extend parallel to each other and/or perpendicularly to the bridge. Also, the bridge need not extend essentially parallel to the gasket. Further, the fingers and/or the connections elements need not be tapered and/or chamfered but may instead have uniform cross sections.

The friction increasing structure of the bridge need not be formed as an elongate projection but can be formed in other ways, for example as a ribbed or rough surface portion. Further, the surface provided with this friction increasing structure need not be the upper surface of the bridge but could be another surface thereof.

The present invention could be used in connection with other types of heat transfer plates than the above described one. Such other plate types could be made of other materials than stainless steel, be provided with a gasket groove of an alternative design or no gasket groove at all, be provided with another pattern, another port hole design or another number of port holes than four.

Finally, the present invention could be used in connection with other types of plate heat exchangers than purely gasketed ones, e.g. plate heat exchangers comprising partly/only permanently joined heat transfer plates, such as welded and semi-welded heat exchangers.

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A gasket arrangement comprising a gasket and an attachment member arranged to engage with an edge portion of a heat exchanger plate for fastening the gasket to a first side of the heat exchanger plate, the attachment member comprising a first connection member, a second connection member and a bridge, a first part of the first connection member engaging with the gasket, a second part of the first connection member engaging with the bridge, a first part of the second connection member engaging with the gasket and a second part of the second connection member engaging with the bridge, the attachment member further comprising a plurality of fingers arranged between the first and second connection members, a respective connection part of each of the fingers engaging with the bridge, the fingers extending from the bridge towards the gasket, wherein at least one of the fingers is arranged to engage with the first side of the heat exchanger plate and at least another one of the fingers is arranged to engage with a second opposite side of the heat exchanger plate, wherein the fingers each have a free end, and wherein the free end of a first one of the fingers is arranged to be positioned closer to the gasket than the free end of a second one of the finders.

2. The gasket arrangement according to claim 1, wherein the free end of a first one of the fingers, which is arranged to engage with the first side of the heat exchanger plate, is arranged to be positioned closer to the gasket than the free end of a second one of the fingers, which is arranged to engage with the second side of the heat exchanger plate.

3. The gasket arrangement according to claim 1, wherein the first one of the fingers is longer than the second one of the fingers.

4. The gasket arrangement according to claim 1, wherein the free end of the first one of the fingers is chamfered at a surface arranged to face the heat exchanger plate, and the free end of the second one of the fingers is chamfered at a surface arranged to face away from the heat exchanger plate.

5. The gasket arrangement according to claim 1, wherein every other one of the fingers is arranged to engage with the first side, and the rest of the fingers is arranged to engage with the second side, of the heat exchanger plate.

6. The gasket arrangement according to claim 1, comprising three fingers of which a middle finger is arranged to engage with the first side of the heat exchanger plate.

7. The gasket arrangement according to claim 1, wherein the bridge has a center portion that is wider than the rest of the bridge.

8. The gasket arrangement according to claim 1, wherein the bridge is thicker than the fingers.

9. The gasket arrangement according to claim 1, wherein the first and second connection members are tapered, so as to be less thick, at their respective first part.

10. The gasket arrangement according to claim 1, wherein the at least one of the fingers arranged to engage with the first side of the heat exchanger plate is tapered, so as to be less thick, at its respective connection part, and the at least another one of the fingers arranged to engage with the second side of the heat exchanger plate is tapered, so as to be thicker at its respective connection part.

11. The gasket arrangement according to claim 1, wherein the gasket and the attachment member are integrally formed.

12. The gasket arrangement according to claim 1, further comprising a plurality of attachment members arranged along the gasket, an infinite straight imaginary line extending parallel to the first side of the heat exchange plate perpendicularly to the gasket, when the gasket is fastened to the heat transfer plate, extending through one of the attachment members only.

13. An assembly comprising a heat exchanger plate and a gasket arrangement according to claim 1.

14. The assembly according to claim 13, wherein the heat exchanger plate comprises, on the first side thereof, a gasket groove extending along an edge of the heat exchanger plate, the edge portion of the heat exchanger plate extending between the edge and the gasket groove and being corrugated so as to comprise alternately arranged ridges and valleys, the gasket being arranged in the gasket groove and the attachment member being arranged around the edge of the heat exchanger plate whereby the first and second connection members and the fingers arranged to engage with the first side of the heat exchanger plate are arranged in a respective one of the valleys of the edge portion and the fingers arranged to engage with the second side of the heat exchanger plate are arranged underneath a respective one of the ridges of the edge portion.

15. A heat exchanger plate gasket assembly mountable on a heat exchanger plate, the heat exchanger plate gasket assembly comprising:

a gasket positionable on a first side of the heat exchanger plate to provide a seal between the heat exchanger plate and another adjacent heat exchanger plate;

an attachment member configured to engage an edge portion of the heat exchanger plate for fastening the gasket in position at the first side of the heat exchanger plate;

the attachment member comprising a first connection member, a second connection member, a bridge and two spaced-apart fingers positioned between the first and second connection members;

the first connection member possessing one end connected to the gasket and an opposite end connected to the bridge so that the first connection member extends between the bridge and the gasket;

the second connection member possessing one end connected to the gasket and an opposite end connected to the bridge so that the second connection member extends between the bridge and the gasket; and the two spaced-apart fingers including one finger and an other finger, the one finger and the other finger each possessing one end connected to the bridge and an opposite free end spaced from the gasket so that the one finger and the other finger each extend from the bridge towards the gasket, the one finger being configured to engage the first side of the heat exchanger plate and the other finger being configured to engage a second side of the heat exchanger plate which is opposite the first side of the heat exchanger plate.

16. A combination of a heater exchanger plate and a gasket assembly, the heat exchanger plate including a first side, a second side and a plurality of port holes each passing through the heat exchanger plate so as to extend from the first side of the heat exchanger plate to the second side of the heat exchanger plate, the gasket assembly comprising:

a gasket;

an attachment member comprising a first connection member, a second connection member, a bridge and two spaced-apart fingers positioned between the first and second connection members;

the first connection member possessing one end connected to the gasket and an opposite end connected to the bridge so that the first connection member extends between the bridge and the gasket;

the second connection member possessing one end connected to the gasket and an opposite end connected to the bridge so that the second connection member extends between the bridge and the gasket; and the plurality of spaced-apart fingers including one finger and an other finger, the one finger and the other finger each possessing one end connected to the bridge, the one finger engaging the first side of the heat exchanger plate and the other finger engaging the second side of the heat exchanger plate.

* * * * *